United States Patent [19]
Tamura
[11] 4,374,038
[45] Feb. 15, 1983

[54] METHOD PRODUCING STEAM-LIKE FUMES FOR TOY ENGINE

[76] Inventor: Muneo Tamura, 195-1, 8-414, Junocho 2-Chome, Omiya-Shi, Saitama 330, Japan

[21] Appl. No.: 232,022
[22] PCT Filed: May 7, 1980
[86] PCT No.: PCT/JP80/00095
§ 371 Date: Jan. 11, 1981
§ 102(e) Date: Jan. 11, 1981
[87] PCT Pub. No.: WO80/02514
PCT Pub. Date: Nov. 27, 1980
[51] Int. Cl.[3] ..... C09K 3/30; A63H 19/14
[52] U.S. Cl. ..... 252/305; 46/9
[58] Field of Search ..... 46/9, 231; 252/305; 219/273; 431/208, 210, 4

[56] References Cited

U.S. PATENT DOCUMENTS

| | | | |
|---|---|---|---|
| 1,363,048 | 12/1920 | MacDonald | 431/210 |
| 1,439,595 | 12/1922 | Woods | 431/210 |
| 1,848,028 | 3/1932 | Ritchie . | |
| 3,342,746 | 9/1967 | Seuthe | 252/305 |
| 3,958,915 | 5/1976 | Noda et al. | 431/4 X |
| 4,008,038 | 2/1977 | Berthiaume | 431/211 X |
| 4,014,637 | 3/1977 | Schena | 431/4 |
| 4,089,633 | 5/1978 | Barghout et al. | 431/208 |

FOREIGN PATENT DOCUMENTS

| | | |
|---|---|---|
| 2631639 | 1/1978 | Fed. Rep. of Germany . |
| 37-13137 | 9/1962 | Japan . |
| 53-38573 | 9/1978 | Japan . |

*Primary Examiner*—F. Barry Shay

[57] ABSTRACT

A fuming or smoke-emitting device used on a model steam locomotive of railway model driven by an electric motor. It is therefore required to reduce the fuming device as much as possible and to simulate the smoke exhausted from the actual locomotive in the smoking state. This fuming device comprises a container which has therein Nichrome wire and is provided at its upper portion with perforation for exhausting the fume or smoke. The container is filled with water and oil having non-affinity with each other. When the heater is heated, the water is boiled to thereby stir the oil. Thus, the oil is burnt, and the smoke of fume thus produced is exhausted by the steam. The fuming state by this combustion phenomenon simulated the smoke exhausted from the actual locomotive, because this fume thus exhausted from the locomotive is similar in principle to the utilization of the steam exhausted usually from the normal cylinder.

1 Claim, 1 Drawing Figure

METHOD PRODUCING STEAM-LIKE FUMES FOR TOY ENGINE

DESCRIPTION

Technical field

The present invention relates to a fuming or smoke-emitting device to simulate the smoke exhausted from the model steam locomotive and the model ship, etc. And more particularly, it is suitable for use on a model steam locomotive of railway. The railway model is different from toys, and its reduced scale and the method of operation are, to some degree, internationally standardized. As for the reduced scale, except minor ones, the two reduced scales are mainly adopted; one is refered to HO-gauge whose reduced scale of model train is about 1/80, another is refered to N-gauge whose reduced scale of model train is about 1/160. As the model locomotive recently tends to become small, N-gauge has been prevailing. The method of operation mostly used is the remote control to supply electric power in the rail from the transformer, from which, through the wheels, the motor gets the driving power. In the smoking state of the fuming device, it is required to simulate the smoke exhausted from the actual smoke locomotive. Although it may be possible to simulate the smoking state regardless of the size of the device and its production cost, the space to load the fuming device is, in actual fact, very restricted due to the reduction of the locomotive and other driving devices. Therefore it is required to reduce the size of the fuming device as much as possible. These requirements are critical. It seems to be impossible to make a small device by means of any mechanical design. So the technical problem is to answer the both requirements; that is, precise simulation of smoking state and reduction of the fuming device.

Background art

Any fuming method, tried so far, uses smoke produced by burning oil, and there are two general methods for exhausting the produced smoke, namely one has recourse to the mechanical device for burning and another has recourse to an air blower. In the former method, the smoking state has not been performed satisfactorily and the latter method requires an exaggerated device. However, one couldn't help compromising in using them to some extent. Some types of fuming devices are sold now. Among the products appeared in the "Tetsudo Mokei Shumi (Hobby of the Railway Model)", which is the Japanese special book of railway model, typical one is the product of West Germany which is the example of the specially designed device for burning. In the following, the explanation of the device is cited and summarized. "In West Germany, SEUTE sells some kinds of fuming devices. In Japan, the devices of product-numbers 99 and/or 100 for HO-gauge are familiar. Inner structure is very simple; there stands a thin steam pipe like an injection-needle in its center, and the upper part of it, about 7 mm long, is a heater with thin Nichrome wire wound. The oil for burning is stored in the botton of the device and the oil is pumped due to capillarity action in the pipe, then heated and evaporated by the heater and ejected upward. This process is made intermittently, so the white smoke continues to eject so long as the oil exists." But the following comments are made that the smoking state doesn't resemble and the amount of the smoke is too little and that the power of ejection is too little. The size of the device is relatively small, but the burning method requires the device to be set vertically, so the model locomotives available to the device are limited. Another typical product is one of Japan. In the following, the explanation of the device is cited and summarized. "A fuming device whose chamber for making smoke and blower are separated, and is designed for tender. That the amount of smoke is enough and the smoking state varies in accordance with the speed of the locomotive is characteristic." The device is limited to some particular locomotives for use, however, the smoking state is highly estimated.

DISCLOSURE OF INVENTION

Figure 1:
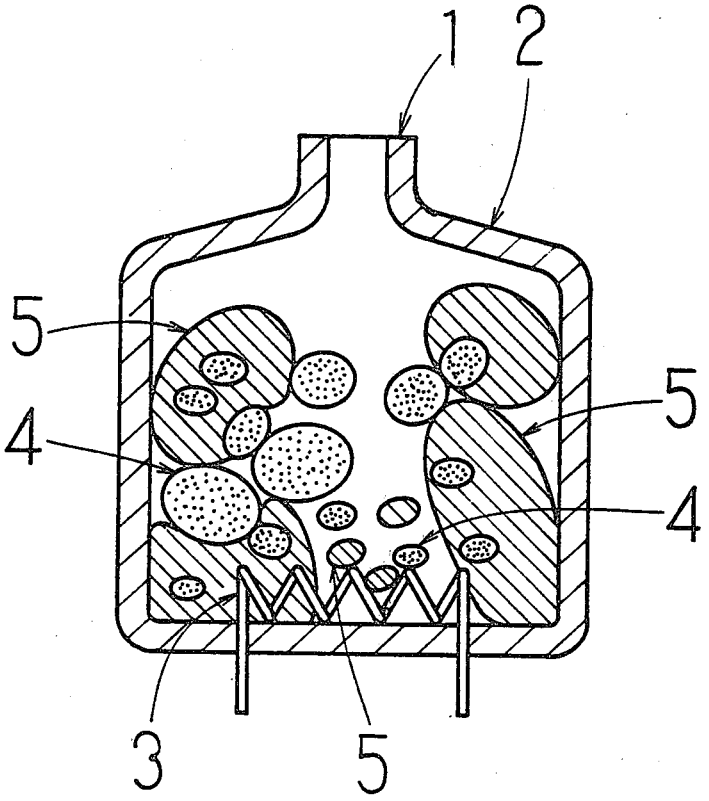
FIG. 1 is a cross-sectional elevation of one device for carrying out the method for producing steam according to the present invention.

According to the present invention, to make the smoke, the oil is burned, however, the characteristic point is that water and oil having non-affinity with each other is burned. Concrete explanation is given below. (FIG. 1 is a cross-sectional elevation of this method for producing steam or smoke.) The Nichrome wire 3 is put as a heater in a container 2 with perforation for a chimney at its upper portion. Through the chimney, water and oil having non-affinity with each other, is put into the container 2. Then the electric power is supplied to the Nichrome 3 and heat the wire 3, so the smoke begins to eject from the chimney, and it is similar to the fume or smoke of a real steam locomotive. In viewing the burning state using a transparent container, the process seems as follows. As the boiling temperature of water is lower than that of oil, the boiled water stirs the oil. Moreover, as the water and oil have non-affinity with each other, the droplets of water 5 and oil 4 are formed when water and oil is heated. The droplets of oil 4 burn and produce smoke in an instant when they touch the Nichrome wire 3 due to the boiling and stirring of the droplets of water 5 and droplets of oil 4. It seems that the produced smoke is ejected from the chimney due to the expansion in volume of water vapor which is evaporated when the droplets of water 5 touch the Nichrome wire 3. The phenomenon that the water droplet, sometimes fallen into the heated oil, bursts are easily found in daily life such as frying. But to burn of oil and water is essentially intentional. And the burning state is very suitable for simulating the fume or smoke of the actual steam locomotive. It is apparent that the fuming state by this combustion phenomenon simulates the smoke exhausted from the actual locomotive, because this fume thus exhausted from the locomotive is similar in principle to the utilization of the steam exhausted usually from the normal cylinder. This invention makes it possible to make a small device because it doesn't require any special mechanical design, so this fuming device is extremely small and simple in structure, and not restricted in its configuration design. Accordingly, this device has an advantage in that it is adapted to be carried on the model locomotive.

Best mode of carrying out the invention

To make a container with perforation for chimney at its upper portion, and on the lowest part in the container the Nichrome wire is put as a heater, two edges of the Nichrome wire are got out from the container. To pour oil and water, having non-affinity with each other, through the chimney into the container. Drinking water is available and the kerosene is suitable. The ration of water to oil depends on the volume of the container, but about 2 to 1 is suitable.

Industrial applicability

In Japan, the device is already sold. Its low cost and utility, compared with ordinary ones, are highly estimated.

I claim:

1. In a method for producing fumes appearing like steam for the chimney of a toy steam engine, the method comprising the steps of depositing water and oil having a non-affinity with the water in a container having an open end and an electrically conductive wire exposed to contact with said water and oil located adjacent the lowest part of the container, and passing current through said wire to raise the temperature of the oil and water sufficiently to cause the oil to burn and the water to evaporate.

* * * * *